US007819187B2

(12) United States Patent
Graham et al.

(10) Patent No.: US 7,819,187 B2
(45) **Date of Patent: *Oct. 26, 2010**

(54) SYSTEM AND METHOD FOR PRODUCING FLUIDS FROM A SUBTERRANEAN FORMATION

(75) Inventors: Stephen A. Graham, Bellaire, TX (US); Charles E. Graham, III, Austin, TX (US); Jonathon G. Weiss, Fort Worth, TX (US)

(73) Assignees: Halliburton Energy Services, Inc., Houston, TX (US); Dynamic Production, Inc., Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/256,720

(22) Filed: Oct. 23, 2008

(65) Prior Publication Data

US 2009/0038792 A1 Feb. 12, 2009

Related U.S. Application Data

(63) Continuation of application No. 11/331,293, filed on Jan. 12, 2006, now Pat. No. 7,451,814.

(60) Provisional application No. 60/644,385, filed on Jan. 14, 2005.

(51) Int. Cl.
*E21B 43/20* (2006.01)
*E21B 43/12* (2006.01)
*E03B 5/02* (2006.01)

(52) U.S. Cl. ..... 166/245; 166/50; 166/52; 166/369

(58) Field of Classification Search ..... 166/52, 166/245, 268, 50, 369
See application file for complete search history.

(56) References Cited

U.S. PATENT DOCUMENTS

| | | | |
|---|---|---|---|
| 2,970,826 | A | 2/1961 | Woodruff |
| 3,386,508 | A | 6/1968 | Bielstein et al. |
| 4,016,942 | A | 4/1977 | Wallis et al. |
| 4,248,302 | A | 2/1981 | Churchman |
| 4,390,067 | A | 6/1983 | Willman |
| 4,458,945 | A | 7/1984 | Ayler et al. |
| 4,519,463 | A | 5/1985 | Schuh |
| 4,532,986 | A | 8/1985 | Mims et al. |
| 4,646,836 | A | 3/1987 | Goodhart |
| 4,682,652 | A | 7/1987 | Huang et al. |
| 5,074,360 | A | 12/1991 | Guinn |

(Continued)

FOREIGN PATENT DOCUMENTS

| | | |
|---|---|---|
| WO | WO 03/095795 | 11/2003 |

(Continued)

*Primary Examiner*—Zakiya W Bates
*Assistant Examiner*—Angela M DiTrani
(74) *Attorney, Agent, or Firm*—Browning Bushman P.C.

(57) ABSTRACT

The system of subterranean wells includes a subsurface flow line 20 having at least a portion within or underlining one or more subterranean formations 12. One or more drainage wells 26, 28, 30, 32, and 34 each extend from the surface and intercept at least one of the subterranean formations at a respective interception location. A lower portion of each drainage well is in fluid communication with the subsurface flow line. A recovery well 42 extends from the surface and is also in fluid communication with the subsurface flow line, so that fluids entering the drainage well flow into the subsurface flow line and then into the recovery well.

36 Claims, 5 Drawing Sheets

U.S. PATENT DOCUMENTS

| | | | | |
|---|---|---|---|---|
| 5,145,003 | A | 9/1992 | Duerksen | |
| 5,258,755 | A | 11/1993 | Kuckes | |
| 5,402,851 | A | 4/1995 | Baiton | |
| 5,450,902 | A | 9/1995 | Matthews | |
| 5,732,776 | A * | 3/1998 | Tubel et al. | 166/250.15 |
| 6,119,776 | A | 9/2000 | Graham et al. | |
| 6,263,965 | B1 | 7/2001 | Schmidt et al. | |
| 6,681,855 | B2 | 1/2004 | Zupanick et al. | |
| 6,729,394 | B1 | 5/2004 | Hassan et al. | |
| 6,848,508 | B2 | 2/2005 | Zupanick | |
| 7,264,048 | B2 | 9/2007 | Zupanick et al. | |
| 7,451,814 | B2 * | 11/2008 | Graham et al. | 166/268 |
| 2005/0241834 | A1 | 11/2005 | McGlothen et al. | |
| 2006/0124360 | A1 | 6/2006 | Lee et al. | |
| 2006/0157242 | A1 | 7/2006 | Graham et al. | |

FOREIGN PATENT DOCUMENTS

| | | |
|---|---|---|
| WO | WO 2006/053434 | 5/2006 |

* cited by examiner

SYSTEM AND METHOD FOR PRODUCING FLUIDS FROM A SUBTERRANEAN FORMATION

CROSS REFERENCE TO RELATED APPLICATIONS

This application is a continuation of U.S. patent application Ser. No. 11/331,293 filed Jan. 12, 2006 now U.S. Pat. No. 7,451,814 for SYSTEM AND METHOD FOR PRODUCING FLUIDS FROM A SUBTERRANEAN FORMATION, incorporated herein in its entirety for all purposes.

RELATED CASE

This application claims priority from U.S. Ser. No. 60/644,385 filed Jan. 14, 2005.

FIELD OF THE INVENTION

The present invention relates to equipment and techniques for producing fluids from a subterranean formation. More particularly, this invention relates to improved techniques for utilizing multiple wells to recover oil or other formation fluids in a manner more efficient than if fluids were recovered from each individual well.

BACKGROUND OF THE INVENTION

Oil is typically recovered from individual wells, including wells which are pumped with a downhole pump powered by a rod string. Problems with conventional technology for recovering subsurface hydrocarbons include lenticular pay zones which are relatively small and heterogeneous, and situations where reservoir quality in adjacent sand lenses targeted for a single frac stage vary considerably. Pressure depletion may be higher in one zone, and fracture stimulation methodologies may be inefficient and largely ineffective because frac stages targeting multiple lenses may travel in a single interval with the highest depletion and lowest fracture gradient. Even in situations where the reservoir quality and pressure in adjacent sand lenses targeted for a single frac stage are similar, current methods may yield limited fracture half-lengths in a single zone and leave many zones under-stimulated due to constraints in pump rate and fluid viscosity to avoid excess frac height growth. Petrophysical evaluation of log analysis varies considerably due to variations in lithology, variable and extremely low water salinities, and unknown fluid invasion profiles. Many wells encounter thin production sand stingers with an average thickness of from 5 to 20 feet, in which case it is not practical to complete all of the zones due to the need for fracture stimulation. Many thin zones are deemed too marginal to perforate and stimulate.

Wells must be substantially vertical if beam pump lift systems are used, so that field areas with difficult access roads and location issues cannot be economically exploited. Moreover, there is no effective way to test oil and water productivity per zone while producing with a beam pump lift system. Paraffin deposition is problematic during the production phase, and there is a need to reduce development and lifting costs for effective production. Offshore or land development where surface constraints do not allow a high density of well development are not practical due to the need for a dedicated beam pump artificial lift system. Significant completion times are required for swab testing and fracture simulation using jointed tubing. Frac treatments can also be problematic on initial completion because rock properties of sand and shales are similar.

Various techniques have been employed for increasing the recovery of oil and other subterranean fluids utilizing a cooperative arrangement between wells. In some applications, water, natural gas, nitrogen, carbon dioxide, steam or another fluid may be injected in one well so that oil is driven toward a production well spaced from the first well. In cases where secondary water injection augments the gas drive mechanism, high volume artificial lift systems are commonly employed in the production phase. Solution gas drive is the typical primary drive mechanism in such relatively small, compartmentalized reservoirs. Secondary recovery with water injection from one well and recovery from another well for pressure maintenance and sweep generally are inefficient due to variabilities of rock properties and unknown continuity of sand lenses between wells. Injection of water in offset wells targeting specific zones for pressure maintenance and oil sweep generally do not allow the operator to know if injected water has experienced premature breakthrough in the production zone, since all zones are commingled and only total water and water rates are measured.

In other applications, a single well is drilled from the surface, and multiple horizontal or lateral wells extend from the vertical well to maximize the recovery of oil from the well. Various problems nevertheless exist with respect to prior art approaches for utilizing existing technology to recover formation fluids. Holes are conventionally drilled, logged, and tested to identify sand stingers for completion. Pay zones may be also selected in part based upon geologic mapping, cross sections, and both petrophysical and fluid analysis. Generally, a production casing is set with cement to cover the entire sand or shale zone, and all zones to be tested are perforated or fraced with a casing gun. The use of production tubing with suitable bridge plugs or packer assemblies to isolate specific zones for swab testing involves expensive rig time. Many times, cement, water, or gas zones must be squeezed, and the sand in the wellbore must be cleaned out and a swab test again performed, which is also rig time intensive and costly. Further rig time is used to fracture or stimulate a single zone or groups of stingers using multiple frac stages. Cement zones are typically squeezed of excess water if the zone significantly reduces production from other wells. Large beam pumps are typically used for artificial lift to pump the oil to the surface, and wells typically are worked over with operations involving swab tests, squeeze cementing, or recompleting operations. The inability to test production influx from specific zones during the production mode is also a problem, since all zones are typically commingled and produced with beam pump lift systems. Paraffin deposition on rods and tubing in production wells is a significant problem since produced oil moves slowly toward the surface, and is cooled as it travels upward in the well. High operating costs thus result from prior art techniques and equipment to recover subterranean formation fluids.

A number of challenges are commonly encountered when using a current exploitation approach, including:

- Significant completion times are required for swab testing and fracture simulation using jointed tubing.
- Lenticular pay zones are often relatively small in size with heterogeneous rock properties and thus require companies developing such reserves to drill wells on very small well spacings. High well densities are often required to exploit the multitude of relatively small sand lenses or reservoir compartments which may be very costly. When viewed in aggregate, the multiple stacked reservoirs may contain significant oil in place, but when only a single reservoir compartment is completed for production, the development may be uneconomic. Offshore or land development where surface constraints do not allow a high density of well development are not practical due to the need for a dedicated beam pump artificial lift system.

Many wells encounter thin production sand stingers with an average thickness of from 5 to 20 feet, in which case it is not practical to complete all of the zones due to the need for fracture stimulation. Many thin zones are deemed too marginal to perforate and stimulate using current completion practices.

In situations where reservoir quality in adjacent sand lenses targeted for a single fracture stimulation stage vary considerably or where pressure depletion is higher in one zone, current fracture stimulation methodologies may be inefficient and largely ineffective because fracture stages targeting multiple lenses will go in the single interval with the highest depletion/lowest fracture gradient.

In situations where the reservoir quality and pressure in adjacent sand lenses targeted for a single fracture stage are similar, current stimulation methods may yield limited fracture half-lengths in a single zone and leaves many zones under-stimulated due mainly to constraints in pump rate and fluid viscosity to avoid excessive fracture height growth.

Secondary recovery with water, gas, and/or steam injection from one well and recovery from another well for pressure maintenance and sweep generally are inefficient due to: (1) variability of rock properties, and (2) unknown continuity of sand lenses between wells.

Petrophysical evaluation through log analysis is complicated due to: (1) variations in lithology, (2) variable and extremely low water salinities, and (3) unknown fluid invasion profiles.

Many thin zones will be deemed too marginal to perforate and stimulate due to the relatively high cost of completion.

Wells must be substantially vertical if beam pump lift systems are used, thus field areas with difficult access road and location issues or in many offshore environments cannot be economically exploited.

Currently available methods do not allow one to test oil, water and gas productivity per zone while producing the commingled sand/shale sequences with beam pump lift systems. Injection of water, steam, and/or gases in offset wells targeting specific zones for pressure maintenance and oil sweep generally do not allow the operator to know if injected water has experienced premature breakthrough in the completed zone of the production wells, since all zones are commingled and only total water and water rates are measured. Current completion and production approaches in these oilfield development situations require expensive and time consuming rig intervention using a swab testing procedure in an attempt to ascertain which zones will yield excessive water, steam, and/or gas.

In many oilfields, paraffin deposition inside the production tubing and on the exterior of rod strings in production wells is problematic during production phase. As the crude oil moves relatively slowly up the tubing string towards the surface, the oil cools which contributes significantly to the problem. Removing such paraffin from downhole tubing and rod strings is a costly problem in many such oilfield developments.

Paraffin deposition on rods and tubing in production wells is a significant problem since produced oil moves slowly toward the surface, and is cooled as it travels upward in the well.

In other exploitation approaches, a single well is drilled from the surface, and multiple horizontal or lateral wells extend from the vertical well to maximize the recovery of oil from the well. Various problems nevertheless exist with respect to prior art approaches for utilizing existing technology to recover formation fluids. High operating costs thus result from prior art techniques and equipment to recover subterranean formation fluids.

U.S. Pat. No. 5,074,360 discloses a substantially horizontal wellbore drilled to intercept a pre-existing substantially vertical wellbore. The horizontal wellbore may be drilled from the surface, and multiple horizontal wells may be drilled to intercept a common vertical well, or drilled from a common site to multiple vertical wells. U.S. Pat. No. 4,458,945 discloses a system which utilizes vertical access shafts which extend through the oil and gas bearing zone. A piping system is laid through horizontal tunnels which interconnect the production wells intercepting a plurality of drainage-type mine sites to a pump at the base of a vertical axis shaft, thereby pumping the collected oil and gas to the surface. The production wells extend from the horizontal tunnel upward to the production zone. U.S. Pat. No. 6,848,508 discloses an entry well extending from the surface toward a subterranean zone. Slant wells extend from the terminus of an entry wellbore to the subterranean zone, or may alternatively extend from any other suitable portion of entry. Where there are multiple subterranean zones at varying depths, slant wells may extend through the subterranean zone closest to the surface into and through the deepest subterranean zone. Articulated wellbores may extend from each slant well into each subterranean zone. U.S. Pat. No. 6,119,776 discloses a method of producing oil using vertically spaced horizontal well portions with fractures extending between these portions.

The disadvantages of the prior art are overcome by the present invention, and an improved system and method are hereinafter disclosed for producing fluids from a subterranean formation.

SUMMARY OF THE INVENTION

In one embodiment, a system for producing fluids from one or more subterranean formations includes a subsurface flow line having at least a portion within or underlying the one or more subterranean formations, one or more drainage wells each extending from the surface, and a recovery well extending from the surface. Each drainage well intercepts the one or more subterranean formations and has a lower end in fluid communication with the subsurface flow line well. The recovery well includes a production string, and is in fluid communication with the subsurface flow line.

In another embodiment, a system includes a plurality of drainage wells each extending from the surface and intercepting the one or more subterranean formations. Each of the drainage wells has a lower end in fluid communication with the subsurface flow line. A pump may be provided for pumping fluids from the recovery well to the surface.

According to one embodiment of the method of producing fluids from one or more subterranean formations, a subsurface flow line is drilled with at least a portion within or underlying the one or more subterranean formations. The method includes providing one or more drainage wells each extending from the surface and intercepting the one or more subterranean formations and having a lower end in fluid communication with the subsurface flow line. A recovery well extending from the surface is provided to be in fluid connection with the subsurface of the flow line. Fluids may be recovered from the lower end of the recovery well.

Further embodiments and features and advantages of the present invention will become apparent from the following detailed description, wherein reference is made to the figures in the accompanying drawings.

DETAILED DESCRIPTION OF PREFERRED EMBODIMENTS

The present invention may be used in the recovery of hydrocarbons in oilfield development applications whereby the hydrocarbons are dispersed in stacked sequence of highly compartmentalized reservoirs within a relatively thick gross interval of permeable sands and impermeable, non-productive shales. In many cases, the desired hydrocarbon production is crude oil from relatively small sand lenses or reservoir compartments having poor reservoir continuity and heterogeneous rock properties, and which commonly require fracture stimulation. Due to the relatively small size of each sand lense or reservoir compartment, commingling of many separate zones into a single completion achieves efficient and economic exploitation.

Figure 1:
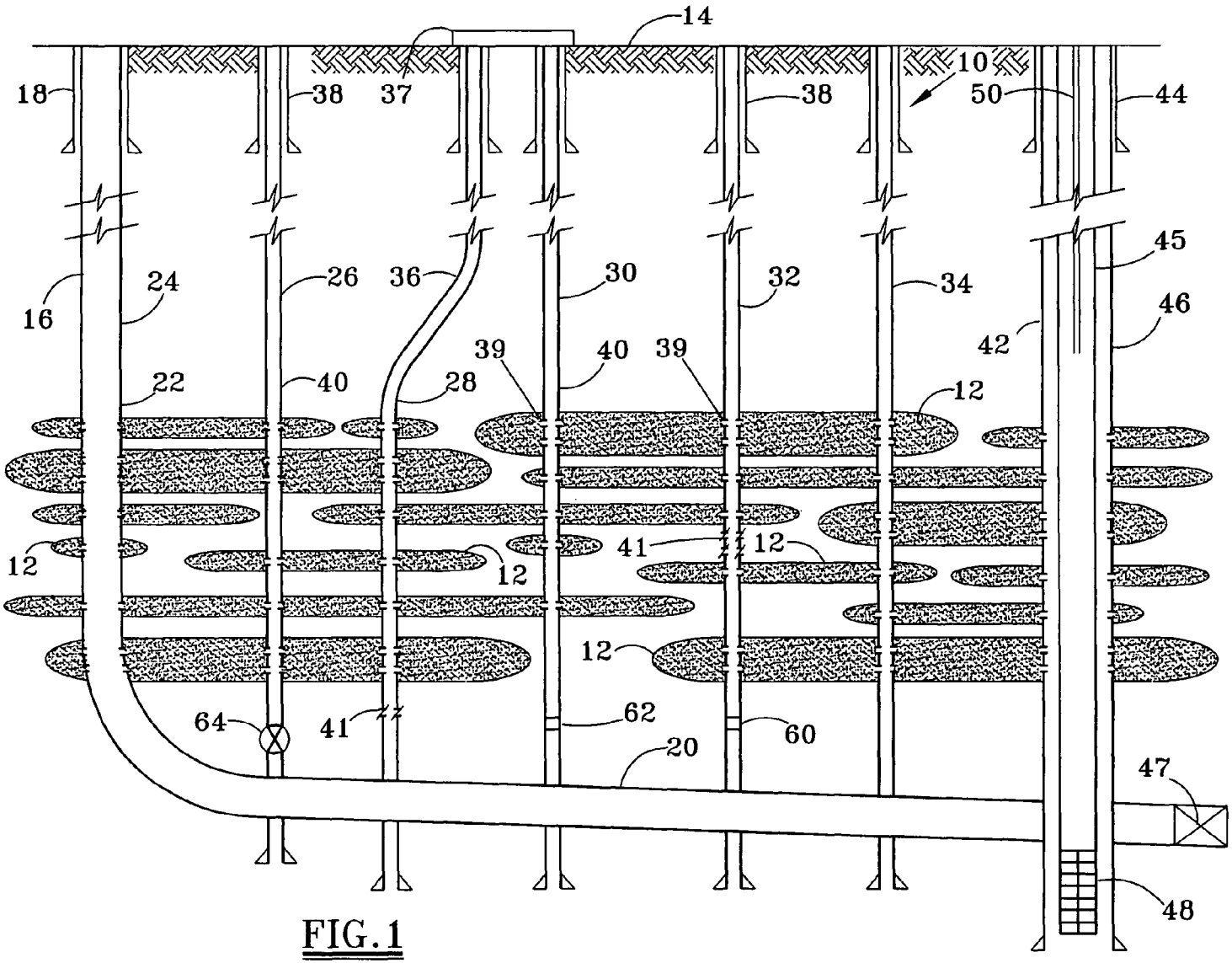
FIG. 1 is a side view of one embodiment of a system for recovering oil according to the present invention.
Figure 5:
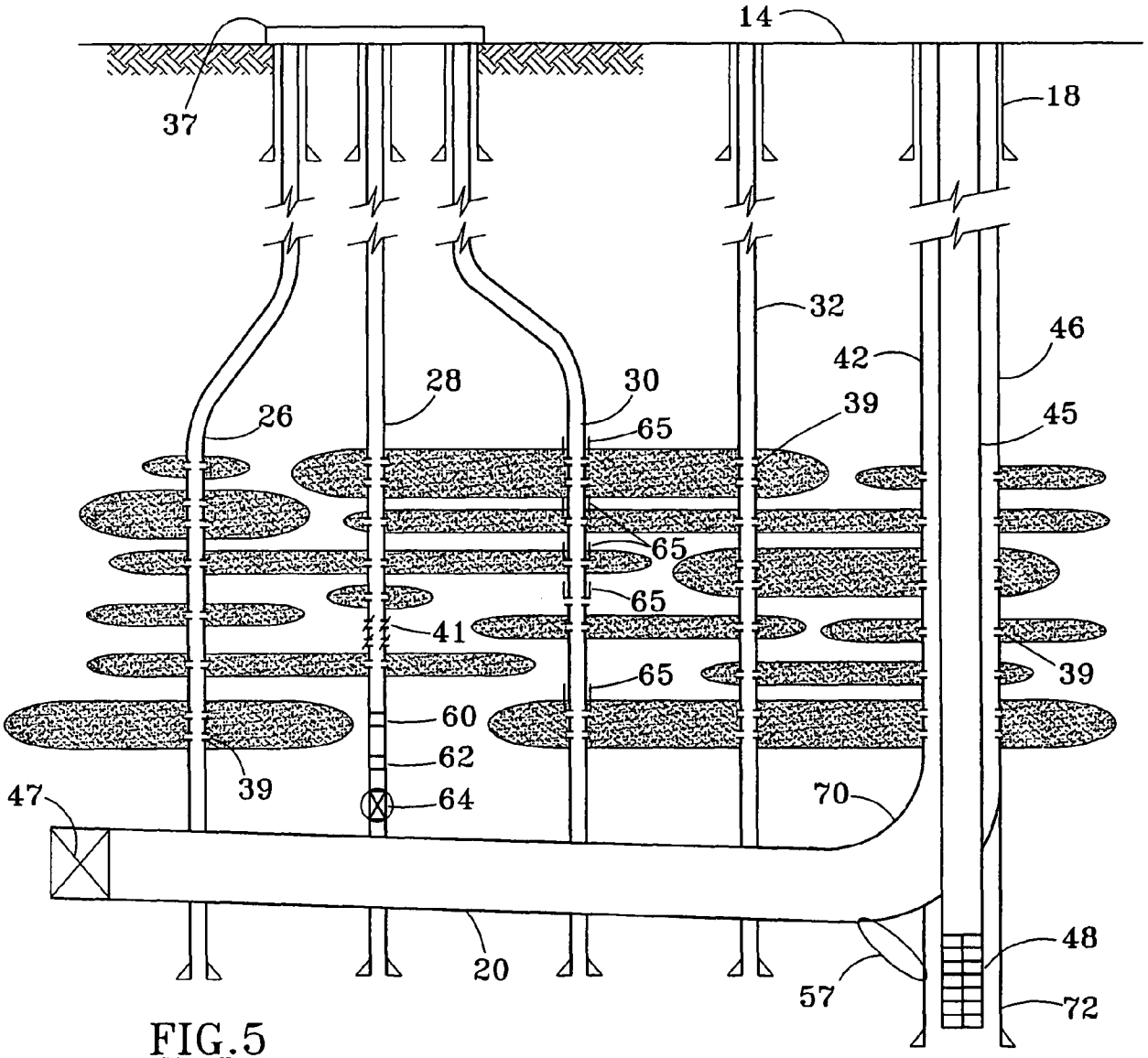
FIG. 5 is a side view of another embodiment of a system for recovering formation fluids.
Figure 6:
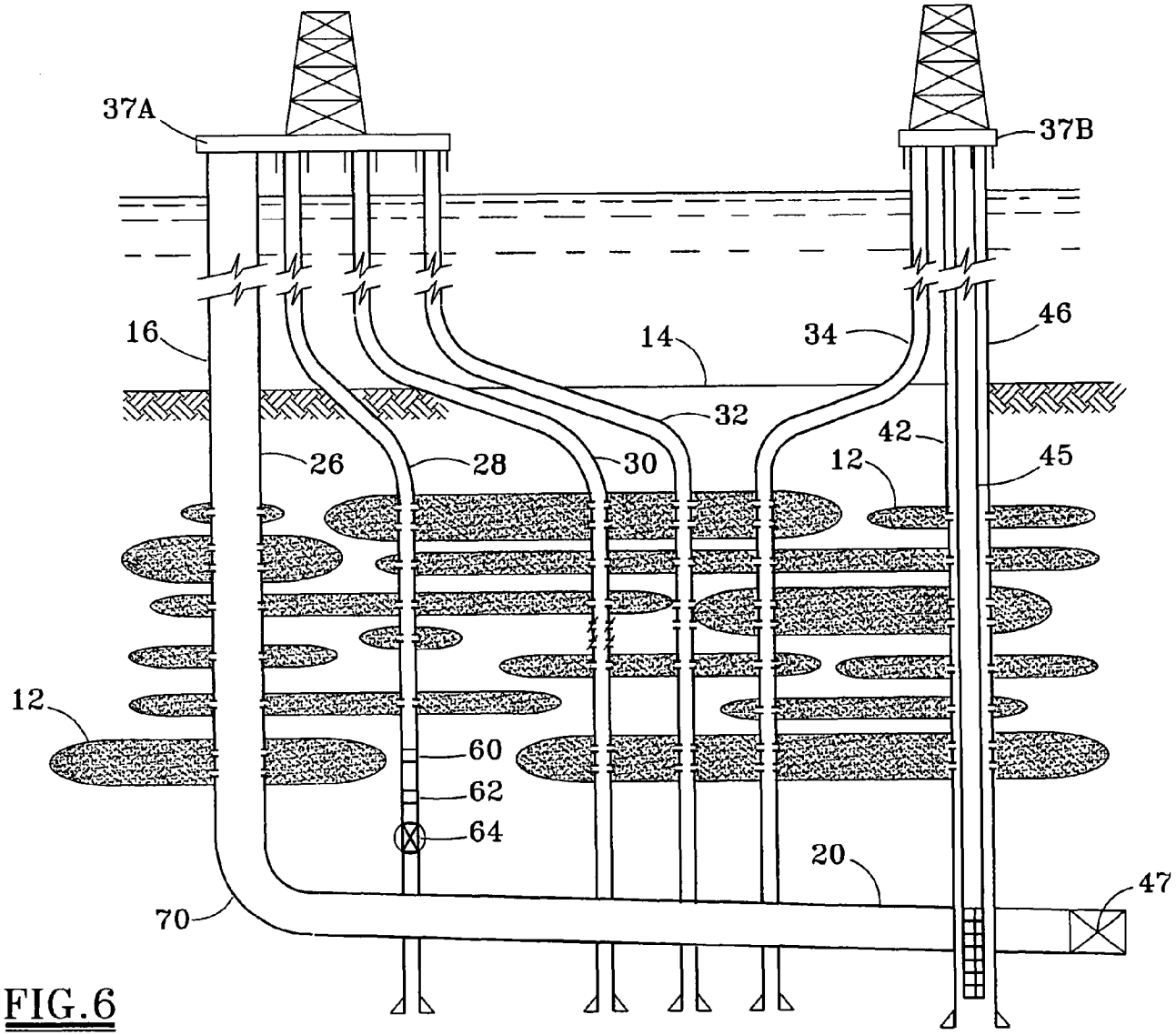
FIG. 6 is a side view of a system for recovering formation fluids in an offshore application.

In one embodiment, the present invention enables a large number of relatively thin reservoirs to be efficiently completed, optionally with frac stimulation, from a subsurface flow line and multiple drainage wells. As shown in FIGS. 1, 5, and 6, vertically spaced reservoirs containing hydrocarbons are thus separated by one or more fluid impermeable layers. The subsurface flow line is in fluid communication with a recovery well. Utilizing this drainage technique, a relatively large field area may be developed with a single recovery well and a single artificial lift system such as an electric submersible pump, a reciprocating rod pump driven by a pump jack, a progressive cavity pump powered by a rotating rod string, a hydraulically powered jet pump, or from a gas lift system. Instead of having numerous vertical wells each pumping a field to recover hydrocarbons from a given field area, the production from the field area can be combined into one recovery well.

FIG. 1 illustrates a system 10 for the recovery of fluids from one or more subterranean formations 12. The system includes a plurality of wells each extending from the surface 14. Those skilled in the art will recognize that each of the wells disclosed herein may be drilled as part of the program to recover fluid from the subterranean formations, or one or more of the wells may be existing, as explained further below, so that the other wells are drilled to cooperate with the existing well(s) to recover fluids. In FIG. 1, a primary drainage well 16 extends from the surface and through the surface casing 18, through the plurality of subterranean formations 12, and then is deflected to result in an subsurface flow line 20 which has at least a portion which is either within or underlies the one or more subterranean formations. In a preferred embodiment, the vertical section 22 of the primary drainage well includes a casing 24 which extends through the plurality of subterranean formations 12 and is subsequently perforated within the producing zones so that fluids will drain by gravity into the subsurface flow line 20. For the embodiment depicted, the casing 24 in the primary drainage well 16 terminates below the lowermost subterranean formation 12, and is inclined in a generally horizontal manner below the subterranean formations to be produced in a given field area to form the subsurface flow line 20. The end of the flow line 20 may be closed off by various conventional mechanisms, including simply terminating the drilling process or providing a plug 47 near the end of the flow line.

Figure 2:
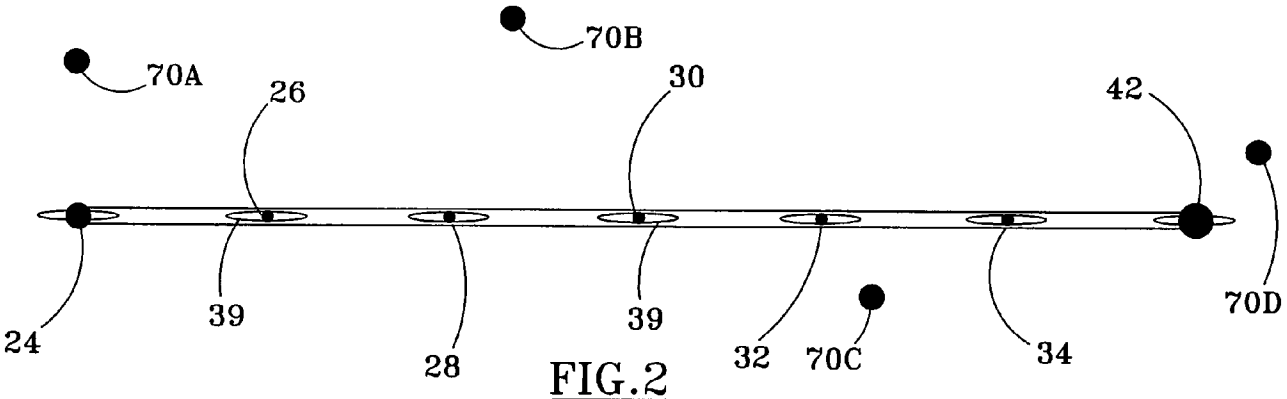
FIG. 2 is a top view of the various wells shown in FIG. 1.

A plurality of secondary drainage wells 26, 28, 30, 32, and 34 are shown each extending from the surface and intercepting one or more subterranean formations 12, such that a lower portion of each of these secondary drainage wells is in fluid communication with the subsurface flow line 20 of the primary drainage well. These secondary drainage wells may be substantially vertical, such as wells 26, 30, 32, and 34, or may have one or more deviated section 36, as shown for well 28, thereby allowing more than one well to extend downward from the same surface pad 37, while still laterally spacing the secondary wells which pass through the formations. Again, each of the secondary drainage wells may be perforated to allow formation fluid to drain into the respective secondary drainage well, and then into the subsurface flow line 20 of the primary drainage well. Each secondary drainage well may include a surface casing 38, with a secondary drainage well casing 40 extending through the surface casing, through the plurality of formations, and into fluid communication with the subsurface flow line 20 of the primary drainage well 16. Each secondary well may thus subsequently be perforated as shown in FIGS. 1 and 2 to include fracture planes 39 which provide for the recovery of fluids by drainage from the subterranean formation. Previous perforations in a drainage well may be closed off to block flow to the well, as shown in FIG. 1 by perforation blocks 41. FIG. 1 illustrates a valve 64 near the lower end of drainage well 26, and sensors 62 and 60 in drainage wells 30 and 32, respectively. These components in the drainage well may be used to control flow or to sense fluid conditions or fluid flow rates, as discussed below.

This system also includes a recovery well 42 which has a surface casing 44 and a casing 46 which as shown is also perforated in the zones of the subterranean formations. A production string 45 is provided within the casing 46, and extends downward to a high capacity pump 48. The production string may be a relatively large diameter tubular. The lower end of the recovery well 42 is thus in fluid communication with a lower portion of the subsurface flow line 20 of the primary drainage well 16, such that fluid from the vertical section of the primary well and from each of the secondary drainage wells flows by gravity or by a pressure differential into the subsurface flow line 20, and then into the lower portion of the recovery well 42. Fluid from the primary drainage well and each of the secondary drainage wells thus flows to the recovery well, where an electric submersible pump, a rod powered pump, a jet pump, or a gas lift system may be used to pump fluids through the production string 45 to the surface.

In preferred embodiments, the subsurface flow line of the primary well is angled toward a lower end of the recovery well at plus or minus 45 degrees from horizontal, and in many applications is angled downward at less than 20° from horizontal toward the lower end of the recovery well. The subsurface flow line 20 is sometimes referred to as "inclined" since this flow line is frequently inclined either upward up to about 30° or is inclined downward up to about 45°. The flow line 20 may, however, be substantially horizontal with little or no inclination. If the flow line is upwardly inclined, the hydrostatic head of the fluid in the flow line and/or in the drainage wells may be sufficient to result in fluid flow to the recovery well. In some embodiments, the subsurface flow line may be angled as described in this paragraph between its intersections with one or more secondary drainage wells and the recovery well, yet this section of subsurface flow line between these intersections may include a subsection of subsurface flow line which is angled outside of this range (e.g., a "drop" section steeper than 45 degrees) which may have been drilled for geological or other reasons. In one option, the recovery well 42 is substantially vertical and thus may receive a drive rod 50 powered at the surface for driving the downhole pump 48.

In some embodiments, the section of the primary drainage well 16 above a lower inclined section passes through and is in fluid communication with the one or more subterranean formations 12. This section may be a substantially vertical section of the primary drainage well, which may also include casing perforated for recovery of fluids from the subterranean formations. Each of the one or more secondary drainage wells may also include a casing perforated for recovery of fluids from the subterranean formations. Also, the recovery well 42 itself may pass through and be in fluid communication with the one or more subterranean formations, so that fluids from the formation may drain by gravity to a lower portion of the recovery well and then be pumped to the surface through the production string 45.

When a well is drilled, there may be a mud cake associated with the drilling operation which temporarily blocks fluid communication between the formation and the drilled well. Such a drilled well nevertheless is considered to be in fluid communication with the formation since the mud cake is conventionally penetrated or removed as part of the completion process, or otherwise breaks apart to allow fluid flow between the formation and the drainage well. In some embodiments, screens and/or gravel packing may also be employed in primary and/or secondary drainage wells.

Referring now to FIG. 2, a top view of the system as shown in FIG. 1 illustrates the primary drainage well 16 and each of the plurality of secondary drainage wells 26, 28, 30, 32, and 34. Each of these wells, as well as the recovery well 42, may be perforated. The section of each primary drainage well, each secondary drainage well, and the recovery well could also be open hole, or could have a slotted liner for fluid communication between the fluid bearing formation and each well.

FIG. 2 also illustrates another feature of the invention, wherein one or more injection wells may be used to push or drive fluid to drainage wells, and then through a subsurface flow line and to a recovery well. FIG. 2 thus illustrates injection wells 70A, which may be injected with the desired fluid, such as water, nitrogen, carbon dioxide, steam, or another driving fluid to drive hydrocarbons toward the drainage well 26. Similarly, fluid may be injected in well 70B to drive fluid toward drainage wells 28 and 30. The third injection well 70C may be used to push fluids toward drainage wells 32 and 34. Another injection well 70D may push fluids toward the recovery well 42 which may include perforations for draining fluid to the lower end of the recovery well.

It is a particular feature of the system that the combination of wells includes a plurality of drainage wells, and for many embodiments, three or more drainage wells, each extending from the surface and intercepting at least one of one or more subterranean formations at a respective interception location. A large number of drainage wells increase the flow volume to the flow line 20 and then to the recovery well, where a single lift system is much more economical than providing a lift system for each well. The lower portion of each drainage well is thus in fluid communication with the subsurface flow line 20, such that the subsurface flow line then transmits fluid from the drainage wells to the recovery well.

Figure 3:
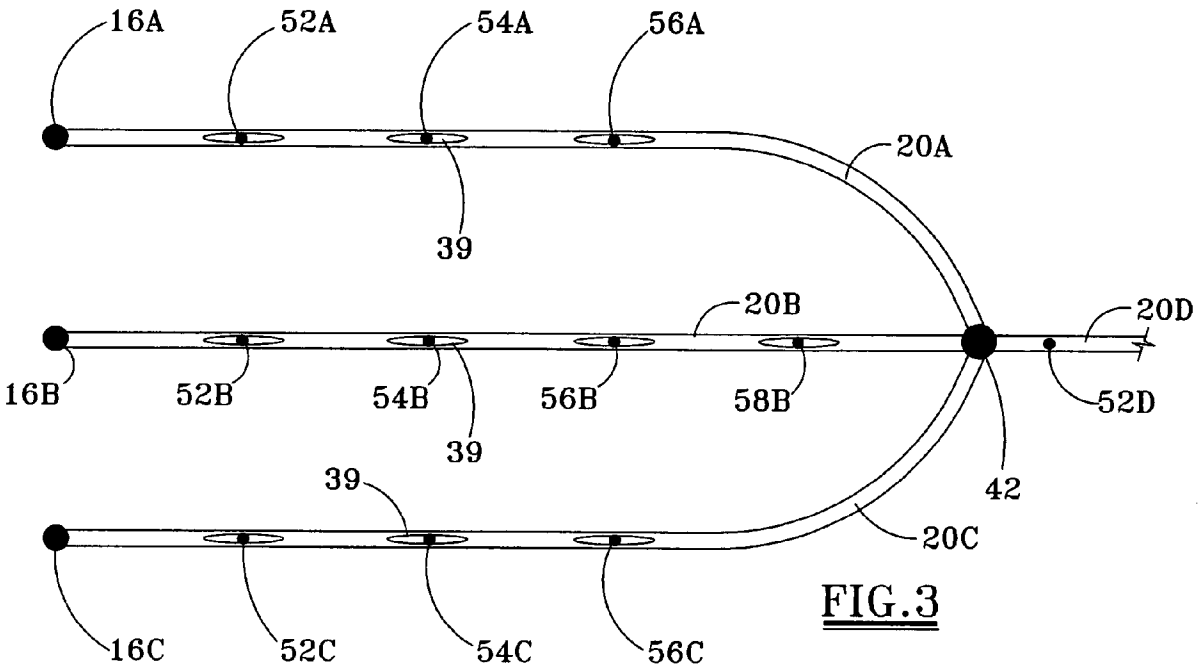
FIG. 3 is a top view of another embodiment of a system according to the present invention.

FIG. 3 illustrates a top view of another embodiment of a system according to the present invention, wherein a plurality of primary drainage wells 16A, 16B and 16C are spaced within a field, and flow toward a single recovery well 42. A plurality of secondary drainage wells 52A, 54A and 56A are each in fluid communication with the subsurface flow line 20A of the primary drainage well 16A, and similarly secondary drainage wells 52B, 54B, 56B and 58B are each in fluid communication with the subsurface flow line 20B of the primary drainage well 16B, while secondary drainage wells 52C, 54C, and 56C are each in fluid communication with the subsurface flow line 20C of the primary drainage well 16C. Each of the primary drainage wells and the secondary drainage wells thus flow toward the same recovery well 42. FIG. 3 also depicts a portion of another subsurface flow line 20D and one secondary well 52D, such that fluid from one or more formations flows by gravity through one or more wells 52D and through flow line 20D to recovery well 42.

Figure 4:
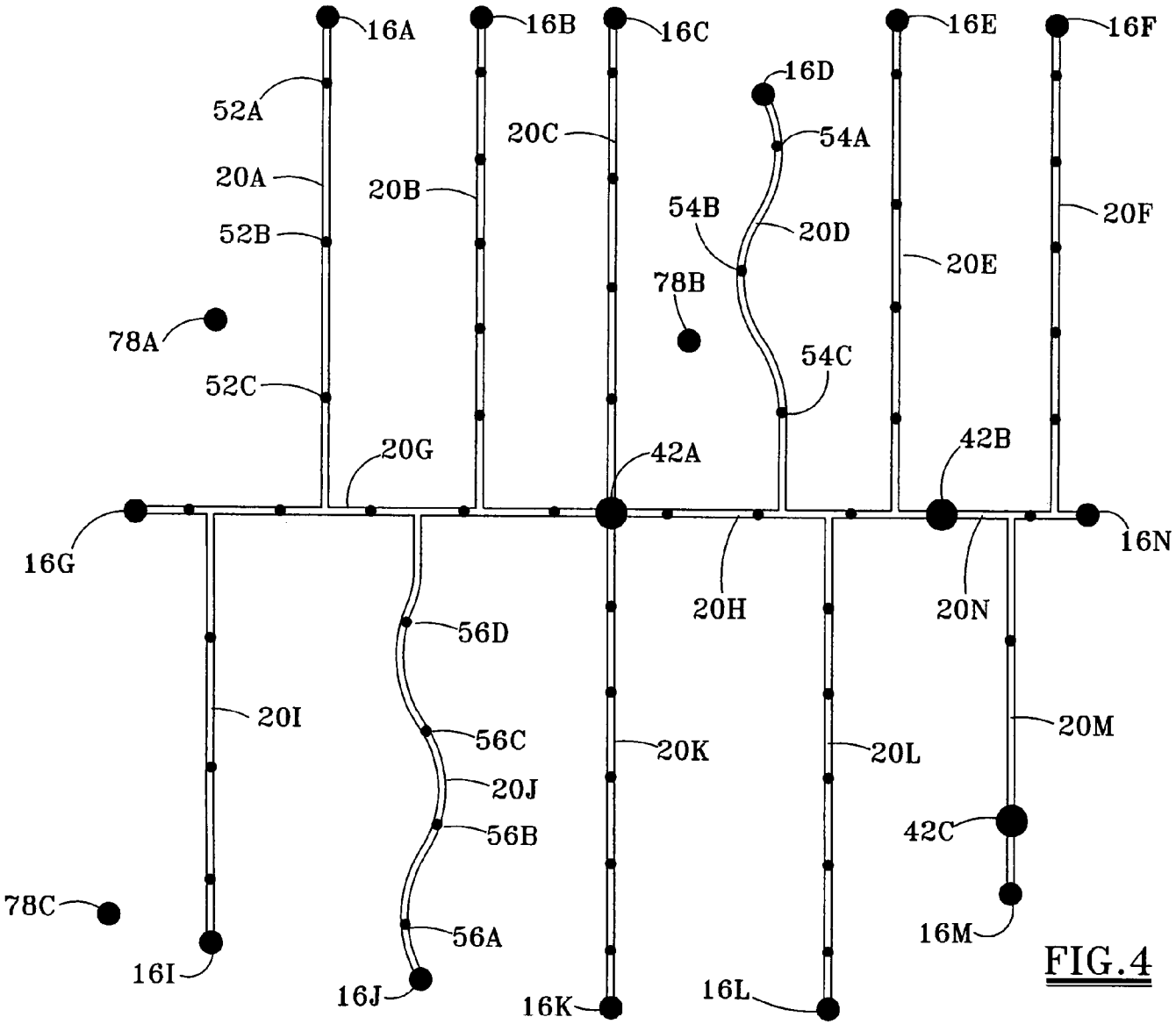
FIG. 4 is a top view of yet another embodiment of a system according to the present invention.

FIG. 4 illustrates yet another embodiment of a system according to the present invention, with primary drainage wells 16A-16G and 161-16N each flowing toward one of the recovery wells 42A, 42B, or 42C, or flowing toward another subsurface flow line 20 of a primary drainage well, which in turn flows to a recovery well. By way of example, primary drainage well 16A includes an subsurface flow line 20A which is in fluid communication with the subsurface flow line 20G of primary drainage well 16G, so that oil which flows from one or more of the secondary drainage wells 52A, 52B, or 52C flows into the subsurface flow line 20A of the primary drainage well 16A, and then flows to a portion of the subsurface flow line 20G of primary well 16G and to the recovery well 42A. The subsurface flow line 20D and 20J of the primary drainage wells 16D and 16J, respectively, are not straight, but instead are curved so as to be in fluid communication with each of the secondary drainage wells 54A, 54B, and 54C, and 56A, 56B, 56C and 56D, respectively. Flow lines 20B, 20C, 20E, 20F, 20I, 20K, 20L, and 20M provide flow lines to at least one of the recovery wells, as shown. A significant benefit of the system according to the present invention is that no production tubing or pumps are provided in the primary drainage wells or the secondary drainage wells. Also, the subsurface flow lines 20 of each primary drainage well in a field are spaced a selected distance from each other, although a plurality of primary drainage wells may be drilled from the same pad or platform utilizing directional drilling techniques.

FIG. 4 also illustrates injection wells 78A, 78B, and 78C which may be used to drive fluid to one or more of the drainage wells, thereby significantly increasing production. If the driving fluid breaks through to a drainage well, a breakthrough may be detected with sensors discussed below with respect to FIG. 5 to detect a change in fluid properties, so that the injection process for that injection well may be discontinued, or the formation with the breakthrough of the driving fluids may be shut in the area surrounding the drainage well.

The FIG. 4 embodiment also illustrates the benefit of providing duplicate recovery wells, so that one recovery well may be shut in, e.g., to repair a pump or the production flow line, while fluid continues to be recovered from the other recovery well. Recovery well 42A could be shut in, while flow line 20H passes fluids to recovery well 42B. Similarly, recovery well 42B could be shut in, and fluids passed to one or both recovery wells 42A or 42C. Continued recovery of fluid is particularly important since the continuous flow of fluid to a recovery well enhances recovery, and because fluid flow once terminated may be difficult to restart. Accordingly, a grid of wells including two or more recovery wells may be preferable for many applications to increase the likelihood of continuous fluid flow to at least one recovery well.

A further feature of the invention is that the recovery wells may be substantially vertical wells, thereby allowing for the use of a reciprocating or a rotating drive rod to power the downhole pump. Also, a substantially vertical recovery well shortens the distance between the pump and the surface. As disclosed herein, it is also advantageous if at least some of the drainage wells can also are substantially vertical wells. This not only shortens the length of the well, but avoids the high expense of special drilling tools and directional drilling techniques which are typically required for wells which are deliberately offset or angled. As disclosed herein, a "substantially vertical" well is one wherein the well is not deliberately drilled with directional drilling techniques, and typically is a well wherein the interception of the well with the subsurface flow line is offset less than about 45 degrees from the surface of the well.

FIG. 5 discloses another embodiment of the invention, wherein the subsurface flow line 20 is a deviation of the recovery well 46. Thus no primary flow line is provided for this embodiment. The drainage wells 26, 28, 30, and 32 may thus include perforations for recovery of hydrocarbons, with hydrocarbons flowing by gravity through the respective drainage well to the subsurface flow line 20, and then into the lower portion 72 of the recovery well 46, which contains a fluid pump or other system for recovering oil to the surface. The relatively short radius then may thus be provided for the transition 70 between the recovery well and the subsurface flow line 20, and if desired the interval between a lower end of the subsurface flow line and the lower portion 72 of the recovery well may include one or more fractures or perforations 57 so that a large head of fluid is not required to have oil flow by gravity from the subsurface flow line 20 into the lower portion 72 of the recovery well.

FIG. 5 also illustrates a surface control valve 64 for controlling the flow of fluid from the drainage well 28 to the subsurface flow line 20, and a fluid property or formation property sensor 60 for sensing a respective property of the fluid being transmitted through the drainage well 28, or the property of the formation surrounding the well 28. Sensor 62 may also be provided in the drainage well 28 for sensing the flow rate of fluid from well 28 to the subsurface flow line 20. In this manner, the quantity of fluid flowing from each drainage well to the subsurface flow line may be monitored, along with the properties of the fluid flowing to the subsurface flow line. In the event, for example, that the flow primarily becomes water rather than oil, the valve 64 may be closed to reduce the outflow from that drainage well.

Intervention operations may also be used to seal off flow from a particular formation to a particular drainage well. Each of the drainage wells may also be provided with a surface controlled valve, such as a sliding sleeve 65, for controlling flow from a particular formation to that drainage well, or from all formations intercepted by that well. FIG. 5 illustrates a sliding sleeve 65 for closing off the perforations provided for each of the perforations in the drainage well 30. Similar control valves may be provided for other of the drainage wells, or for intercepted locations of a particular drainage well with selected formations. If it is determined, for example, that a particular formation is producing water rather than economic amounts of oil, then the control valve at the location of that interception with the drainage well may be closed off, so that oil will continue to flow from other formations to that drainage well. While these are examples, those skilled in the art will appreciate that various types of valves, sliding sleeves, and other means of flow control or zonal isolation may be employed with intervention techniques from surface, or via electric or fiber optic wired, hydraulic, and/or wireless remote control.

FIG. 6 discloses yet another embodiment of the invention used in an offshore application. FIG. 6 illustrates a pair of offshore platforms 37A and 37B. A primary drainage well 16 extends through the mud line 14 and to the subsurface flow line 20 in a manner substantially similar to the primary drainage well and flow line shown in FIG. 1. Three drainage wells 28, 30 and 32 are shown drilled off the same platform, each intercepting a plurality of formations for draining oil into the flow line 20. Drainage well 28 includes a control valve 64 and sensors 60 and 62 as previously discussed. The recovery well 46 is in fluid communication with the flow line 20, and extends from another platform 37B through a plurality of formations 12. Production string 45 is provided within the recovery well 46 as previously discussed for recovery of fluids to the platform 37B. One or more drainage wells 34 also extend from the platform 37B from which the recovery well 46 is drilled, and pass through formations 12 to be in fluid communication with the flow line 20.

Although FIGS. 1, 5 and 6 illustrate each of the drainage wells as being in the same plane as the flow line 20 and the recovery well 46, those skilled in the art should understand that some of the drainage wells may be within or substantially adjacent a plane defined by the recovery well and the flow line, but in other applications other of the drainage wells may be spaced from this plane, such that the lower end of a drainage well may be angled so that a relatively straight flow line 20 will also intercept the lower end of this angled drainage well, or the flow line 20 may be angled to intercept one or more wells which are not within the same plane, as shown for the flow lines 20D and 20J, as shown in FIG. 4. The system of wells may thus have drainage wells which are angled so as to be intercepted by a flow line, or the flow line 20 may be angled at various locations to intercept a drainage well which is not in the same plane as other drainage wells. The plurality of wells according to this invention thus frequently may not lie within a plane as shown in FIGS. 1, 5 and 6 but may have three dimensional characteristics to achieve the purposes set forth herein.

According to the method of producing fluids according to the invention, the primary well is drilled from the surface and includes a subsurface flow line within or underlying the one or more subterranean formations. The method includes drilling or re-completing one or more secondary drainage wells each extending from the surface and intercepting the one or more subterranean formations, and having a lower end in fluid communication with the subsurface flow line of the primary drainage well. The recovery well may be drilled or re-completed extending from the surface to a subsurface flow line to recovery fluids from the lower end of the drainage wells. The recovery well may be drilled to pass through or intercept the one or more subterranean formations, and may be perforated or include a slotted liner that is in fluid communication with these formations. The recovery well may be substantially vertical, so that a drive rod may extend from the surface to power the downhole pump.

In some applications, the drainage wells may be open hole, with no perforated casing or slotted liner to block flow between the formation and the drainage well. In selected applications, one or more of the drainage wells or one or more recovery wells may be previously drilled wells, and may have been used previously as either a recovery well or an injection well. The wells may thus be re-completed to serve as either a drainage well or a recovery well. Zones which were open for injecting fluid into a formation may thus be closed off, and new zones may be perforated or fractured. According to the method of forming the system of subterranean wells as disclosed herein, the one or more drainage wells and recovery wells may first be drilled or re-completed, or as explained above, and an existing well may be used for one or more of these wells. The subsurface flow line is preferably the last segment of a well which is drilled, and may be drilled either by drilling a primary drainage well leading into the subsurface flow line or by drilling a recovery well leading to the subsurface flow line. The subsurface flow line may use conventional techniques to steer the flow line to intercept the lower portion of each drainage well and the recovery well. High reliability of intercepting the subsurface flow line with these drainage wells and recovery wells may be achieved utilizing the Rotary Magnet Ranging System (RMRS) provided by Halliburton Energy Services. This system may utilize a magnet near the bit of the bottomhole assembly of the subsurface flow line well being drilled, which may be either one of the drain lines or the recovery well, and includes a wireline survey instrument run to a location within a few feet of the target interception point in either a drainage well or recovery well. The survey instrument senses the magnetic anomaly when the bit with the magnet approaches the target. The bottomhole assembly is then steered in response to this sensed information so that the bit intercepts the target interception point. Other systems may be used, and may either include a sensor in one well responsive to signals from the other well, or responsive to the target or another component, optionally in the bottomhole assembly, or in the other well. Conventional directional survey techniques may use high accuracy gyro survey tools which may include inertial navigation and/or gyro-while-drilling, as known in the art, magnetic ranging technology tools, or other well intersection tools. In other applications, the one or more drainage wells and/or the recovery well may be drilled after the subsurface flow line is drilled, in which case the drainage well or recovery well may be steered to intersect the subsurface flow line.

Since neither the primary drainage well nor the secondary drainage wells require production tubing, rods or a pump in the hole, full access is available to each well for rigless interventions, such as production logging and other wireline operations or for coiled tubing operations. Zones may be completed without major well intervention. Additionally, determining which zones should be completed, performing remedial work such as frac treatments, conformance treatments for water or gas shutoff, or recompletion techniques using coiled tubing may be efficiently employed on the primary drainage wells and the secondary drainage wells without rig intervention. Also, the techniques of this invention allow for improved reservoir management by quickly determining that water, steam or gas from an injector has broken through to a recovery well in a particular zone without interfering with production from other zones utilizing production logging techniques which do not require a rig for deployment. Various tools may also be used to measure total flow rate and oil cut per zone during the production phase in a drainage well without the need for a workover rig to remove tubing, a pump, or rods. Additionally, the methods of the present invention eliminate the need to test the productivity of zones using swabbing techniques. If an excessive water breakthrough is identified using production logging or downhole permanent sensors, a coiled tubing conformance treatment may be used to shutoff problematic zones and enable injected water or gas to be redirected to another drainage well.

The water source for an injector well may be tagged with a tracer material which can be readily detected by production logging techniques. Continuity of sand lenses between wells may thus be confirmed and injected water flows may be tracked over time.

By producing a zone for a short period of time before fracture treatment, a larger differential of fracture gradient between the sands and shales may be created. In doing so, fracture half lengths may extend beyond conventional lengths due to uncontrollable frac height associated with larger treatments. Wells need not be drilled on tight spacing since the fracture planes themselves could extend beyond the reservoir lenses that are penetrated by the well.

As explained above, the drainage wells do not have to be vertical since the wells need not be rod pumped. Pad and platform drilling of multiple secondary recovery wells is thus practical for offshore fields and land operations which require reduced environmental impact. Directional drilling techniques may be used to penetrate multiple offset "sweet spots" identified by seismic analysis or other means to maximize hydrocarbon recovery.

As disclosed herein, a large number of wells may thus be fluidly connected to a single subsurface recovery well. Fluid is only produced at the one or more recovery wells, and the flow of fluid is generally downward by gravity toward the higher temperature, lower end of the recovery well which has been equipped with a large artificial lift system and production string which has been designed to minimize paraffin buildup during production operations, thereby reducing paraffin redeposits. By providing one large artificial lift system, the cost of a system is lower compared to providing numerous artificial lift systems for each well.

By maintaining full access to the primary and secondary drainage wells, new wells may be completed or recompleted, and wells may be fracture stimulated or refraced at existing hydrocarbon zones or new zones without shutting in the subsurface pipeline recovery system. Production logging of wells may identify opportunities to optimize efficiencies, and zones producing excessive water, steam or gas may be isolated using coiled tubing conveyed conformance chemicals and/or cement. Additionally, chemicals to enhance open-hole wellbore stability may be less expensive than running in a liner in the subsurface flow line or drainage wells.

The concept of the present invention will have applications in numerous oilfield development applications, including those with thick sequences of stratified sand/shale intervals, oil zones requiring fracture stimulation treatments, and zones with poor reservoir continuity and heterogeneous rock properties. The system disclosed herein may also be used for techniques wherein gas expansion is the primary reservoir driving mechanism, and may also be used with techniques involving water, steam and/or gas injection for secondary oil recovery. The high volume artificial lift equipment allows the technique to be used when there is significant water production from secondary recovery operations. Hydrocarbons which include a high paraffin content may be efficiently recovered and oil may be more efficiently recovered compared to traditional exploitation techniques which involve high operating costs, high well densities to exploit multiple small reservoir lenses, weak shale barriers, and workover intervention for zone level testing.

With the applications discussed above, formation fluid flowed by gravity to the recovery well, frequently with the assistance of a pressure differential between the fluid in the drainage well and/or the subsurface flow line, and the reduced pressure at the lower portion of the recovery well which contains the pump or other recovery well lift system. In other applications, the reservoir pressure at each of the interception locations is sufficient that the fluid column in the drainage well may be higher than the respective formation interception location. In those applications, a subsurface flow line could intercept the collection wells above the formation interception locations, since fluid pressure provides the force to drive oil to the subsurface flow line and then to the recovery well. The lower portion of the collection well, although above the formation, would nevertheless be in fluid communication with the subsurface flow line and thus the recovery well. This arrangement may not be preferable since it does not provide for full drainage of the formation, but may have applications in some fields. Note that the wells connected to the subsurface flow line are not called "drainage wells" in this application, since gravity does not assist in moving fluid to the subsurface recovery well.

The terms "intercepting" and "interception" as used herein involve the crossing or intersection of a well or a flow line, such as a drainage well, with a production formation. A "interception location" is the zone in which the well intercepts a production formation. Some or all of each interception location is higher than a lower end of the recovery well to facilitate flow to the recovery well. A subsurface flow line is "within" a formation if any portion of the flow line extends into or otherwise is in any portion of the formation. A subsurface flow line is "underlying" a formation if it is vertically below at least a portion of the formation. The underlying flow line may or may not be laterally spaced from the formation, and in some applications the flow line may be spaced a considerable distance from the interception of one or more drainage wells with the one or more formations.

A "recovery well" as used herein is a well from which fluids are recovered to the surface. A "drainage well" is a well which receives fluids from a formation, and transmits the fluids, commonly with gravity and frequently with a pressure differential assist, to a subsurface flow line and then to a recovery well. A "primary drainage well" may or may not intercept a production formation, and thus may or may not be completed for production.

The term "extending from the surface" when used with respect to a well includes wells drilled from the surface, and wells drilled from another wellbore, e.g., in a multilateral or junction system, with the parent wellbore of such system was drilled from the surface. The "surface" of a well is the uppermost land surface of the land well, and is the mud line of an offshore well. The phrase "controlling flow to the subsurface flow line" includes opening, shutting off, or metering a particular zone for entry to the drainage well.

The term "fluid communication" means that fluid may flow without a significant pressure differential between two locations. Fluid communication may result from the interception of a formation and a well, from the interception of two wells, or from wells being so close that fluids passes without significant restriction between the two wells, optionally due to perforating or fracing the spacing between the wells. The term "fluid" as used herein means a liquid or a combination of a liquid and a gas. Water may thus be recovered with a pump from the recovery well to enhance the flow of hydrocarbon gases from the formation to the surface. In other applications, oil and hydrocarbon gases or oil and water may be recovered from the recovery well. The phrase "intervention operation" means an operation performed from the surface of one or more of the drainage wells, and includes well stimulation, a well cleanout, a wellbore and/or formation testing operation, and a fluid shutoff operation. As used herein, the phrase "stimulation operation" means an operation to stimulate production, and includes perforating or fracturing the formation, acidizing, and wellbore cleanout.

As disclosed herein, one or more drainage wells, and in many applications a plurality of drainage wells, may extend from the surface that intercept at least one of the one or more subterranean formations, with a lower portion of the drainage well being in fluid communication with the subsurface flow line. In an exemplary application, four drainage wells may each intercept the formation and have a lower portion in fluid communication with the subsurface flow line. Additional wells in the field of these four drainage wells, which additional wells may or may not drain formation fluid into the well, are not considered drainage wells as disclosed herein since they do not have a lower portion in fluid communication with the subsurface flow line. One or more of these additional wells may also be a recovery well since fluid may be recovered from the well. It is not, however, a recovery well in fluid communication with a subsurface flow line as disclosed herein, such that fluids entering the one or more drainage wells flow into the subsurface flow line and then to the recovery well.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system of subterranean wells for producing fluids, comprising:

a subsurface flow line extending from the surface and having a lower portion within or underlying at least one subterranean formation;

a plurality of drainage wells each extending from the surface and intercepting the at least one subterranean formation at a respective interception location and having a lower portion in fluid communication with the lower portion of the subsurface flow line, each of the plurality of drainage wells including at least one of a perforated casing or a slotted liner for recovery of at least a portion of the formation fluids from the at least one subterranean formation, such that at least a portion of the formation fluids move down the plurality of drainage wells to the subsurface flow line, points along the subsurface flow line between each location of fluid communication with a drainage well and a common recovery well being angled at 45° or less relative to horizontal; and the common recovery well extending from the surface and in fluid communication with the subsurface flow line, such that at least a portion of the formation fluids entering the plurality of drainage wells from the at least one formation flow into the subsurface flow line and then into the common recovery well.

2. The system as defined in claim 1, wherein the common recovery well has a lower section, and wherein at least a portion of each interception location is higher than said recovery well lower section.

3. The system as defined in claim 1, wherein a portion of the subsurface flow line intercepts at least the one subterranean formation.

4. The system as defined in claim 1, wherein the subsurface flow line is at least partially within a lowermost one of the at least one subterranean formation.

5. The system as defined in claim 1, wherein the recovery well includes a lower portion forming the subsurface flow line.

6. The system as defined in claim 1, further comprising:

another subsurface flow line having a portion underlying at least one subterranean formation;

another plurality of drainage wells each extending from the surface and intercepting the at least one subterranean formation at a respective interception location and having a lower portion in fluid communication with the another subsurface flow line; and the another subsurface flow line being in fluid communication with one of the subsurface flow line and the recovery well, such that fluids from the at least one subterranean formation flows into the another subsurface flow line via the another plurality of drainage wells and into the recovery well.

7. A system for producing fluids from one or more subterranean formations, comprising:

a primary drainage well extending from the surface, the primary drainage well including a subsurface flow line having at least a portion within or underlying at least one subterranean formation;

a plurality of secondary drainage wells each extending from the surface and intercepting the at least one subterranean formation at a respective interception location and having a lower portion in fluid communication with the subsurface flow line, each secondary drainage well including at least one of a perforated casing or a slotted liner within a subterranean formation, such that at least a portion of the formation fluids move down the plurality of drainage wells to the subsurface flow line, each of the plurality of secondary drainage wells including a flow control device for controlling flow from a respective secondary drainage well to the subsurface flow line; and a common recovery well extending from the surface, with a lower portion in fluid communication with the subsurface flow line, the recovery well including a lift system.

8. The system as defined in claim 7, wherein the lift system is at least partially within the lower portion of the recovery well.

9. The system as defined in claim 7, wherein the subsurface flow line between the location of fluid communication with each of the plurality of drainage wells and the location of fluid communication with the recovery well is angled at 45° or less relative to horizontal.

10. The system as defined in claim 7, wherein the recovery well lift system includes one or more of a pump driven from the surface by a drive rod, a hydraulically powered jet pump, and a gas lift valve system.

11. The system as defined in claim 7, wherein the primary drainage well includes a section above the subsurface flow line which intercepts and is in fluid communication with at least one of the one or more subterranean formations such that at least a portion of the formation fluids from the primary drainage well moves to the subsurface flow line.

12. The system as defined in claim 7, wherein the recovery well intercepts and is in fluid communication with the at least one subterranean formation.

13. The system as defined in claim 7, further comprising:

another subsurface flow line having a portion within or underlying at least one of one or more subterranean formations;

another plurality of secondary drainage wells each extending from the surface and intercepting the at least one subterranean formation at a respective interception location and having a lower portion in fluid communication with the another subsurface flow line; and the another subsurface flow line being in fluid communication with one of the subsurface flow line and the recovery well, such that at least a portion of the fluids from the at least one subterranean formation flow into the another subsurface flow line via the another plurality of secondary drainage wells and into the recovery well.

14. The system as defined in claim 7, wherein each of the plurality of secondary drainage wells includes a downhole sensor for sensing one of a formation condition and a fluid condition.

15. The system as defined in claim 7, wherein at least one of the plurality of secondary drainage wells includes a flow control device for controlling flow into a respective secondary drainage well from the at least one subterranean formation.

16. The system as defined in claim 7, further comprising:

an injection well spaced from each of the plurality of secondary drainage wells for injecting fluid into the at least one subterranean formation to move recovery fluids into at least one of the plurality of secondary drainage wells.

17. A method of constructing a well system, comprising:

drilling a plurality of drainage wells each extending from the surface and intercepting at least one subterranean formation at a respective interception location;

drilling a subsurface flow line extending from the surface and having a lower portion within or underlying the at least one subterranean formation, the subsurface flow line in fluid communication with a lower portion of the one or more drainage wells, such that the plurality of drainage wells output the recovered fluids to the lower portion of the subsurface flow line, points along the subsurface flow line between each location of fluid communication with a drainage well and a common recovery well being angled at 45° or less relative to the horizontal;

drilling the common recovery well extending from the surface and in fluid communication with the subsurface flow line; and recovering fluids to the surface through the common recovery well, such that at least a portion of the formation fluids entering the plurality of drainage wells flow through the drainage wells and to the subsurface flow line and then to the recovery well.

18. The method as defined in claim 17, further comprising:

forming at least a portion of the subsurface flow line to be in direct fluid communication with at least the at least one subterranean formation.

19. The method as defined in claim 17, further comprising:

drilling the recovery well to intercept the at least one subterranean formation.

20. The method as defined in claim 17, wherein the subsurface flow line is drilled to be in fluid communication with one or more previously drilled drainage wells and with a previously drilled recovery well.

21. The method as defined in claim 17, wherein each of the plurality of drainage wells is provided with at least one of a perforated casing or a slotted liner for communication of fluids from the at least one subterranean formation.

22. The method as defined in claim 17, wherein the recovery well has a lower section, and wherein at least a portion of the respective interception location of the plurality of drainage wells is higher than the recovery well lower section.

23. The method as defined in claim 17, further comprising:

providing a lift system within the recovery well, the lift system having one or more of a pump driven from the surface by a drive rod, a hydraulically powered jet pump, and a gas lift valve system.

24. The method as defined in claim 17, wherein the recovery well is substantially vertical and a drive rod extends from the surface to power a downhole pump.

25. The method as defined in claim 17, further comprising:

providing a downhole sensor in at least one of the plurality of drainage wells for sensing one of a formation condition and a fluid condition.

26. The method as defined in claim 17, further comprising:

performing well stimulation operation from the surface in at least one of the plurality of drainage wells.

27. The method as defined in claim 26, wherein the well stimulation operation is selected from a group consisting of one or more of a well cleanout, perforating, acidizing, and fracturing the formation.

28. A method of constructing a well system in a field containing one or more existing wells, comprising:

providing a common recovery well or re-completing an existing well as a recovery well, the recovery well extending from the surface and including a lower portion;

providing a plurality of drainage wells or re-completing an existing well as a drainage well, each of the plurality of drainage wells extending from the surface and including a lower portion, each drainage well intercepting one or more formations at respective interception locations;

drilling a subsurface flow line extending from the surface and having a lower portion within or underlying at least one of the one or more subterranean formations, such that the subsurface flow line is drilled for fluid communication with the plurality of drainage wells, the plurality of drainage wells in fluid communication with at least one of the one or more formations such that at least a portion of the formation fluids move down the plurality of drainage wells to the subsurface flow line;

providing fluid communication between the subsurface flow line and the common recovery well, wherein the respective interceptions of the plurality of drainage wells are higher than the recovery well lower portion; and injecting fluids into one or more injection wells spaced from the plurality of drainage wells to move formation fluids into the plurality of drainage wells.

29. The method as defined in claim 28, wherein at least one of the existing drainage wells was previously an injection or recovery well.

30. The method as defined in claim 28, further comprising:

providing a recovery string within the recovery well for recovery of fluids from the lower end of the recovery well to the surface.

31. A method for producing fluids from one or more subterranean formations, the method comprising:

providing a plurality of drainage wells each extending from the surface and intercepting at least one subterranean formation at a respective interception location;

providing a subsurface flow line extending from the surface and having at least a lower portion within or underlying the one or more formations and in fluid communication with a lower portion of the plurality of drainage wells, the plurality of drainage wells in fluid communication with at least one subterranean formation such that at least a portion of the formation fluids flow from the plurality of drainage wells to the subsurface flow line;

providing a common recovery well extending from the surface and in fluid communication with the subsurface flow line;

injecting fluids into one or more injection wells spaced from the plurality of drainage wells to move formation fluids into the plurality of drainage wells; and producing at least a portion of the fluids from the one or more formations downward via the plurality of drainage wells and then into the subsurface flow line and then into the common recovery well and then to the surface.

32. The method defined in claim 31, wherein the subsurface flow line between the location of fluid communication with each drainage well and the location of fluid communication with the recovery well is angled at 45° or less relative to horizontal.

33. The method defined in claim 31, wherein said recovery well has a lower section, and wherein the interception location of each of the one or more drainage wells is higher than said recovery well lower section.

34. The method defined in claim 31, further comprising:

performing a well stimulation operation from the surface in the plurality of drainage wells.

35. The method defined in claim 31, further comprising:

performing a well intervention operation from the surface in the one or more drainage wells while producing fluids from the recovery well, the well intervention operation selected from a group consisting of one or more of a well cleanout, a well and/or formation testing operation, a stimulation operation, a fluid shutoff operation, fluid control device adjustment, and a sensor repair or replacement operation.

36. The method defined in claim 31, further comprising:

providing in at least one of the plurality of drainage wells at least one of a sensor and a flow control device; and altering production from at least one interception location while producing fluids from the recovery well.

* * * * *